US007669962B2

(12) United States Patent
Matsuhashi et al.

(10) Patent No.: US 7,669,962 B2
(45) Date of Patent: Mar. 2, 2010

(54) CAPPING SHEET AND LIQUID JET APPARATUS

(75) Inventors: Kunihiko Matsuhashi, Matsumoto (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 674 days.

(21) Appl. No.: 11/557,904

(22) Filed: Nov. 8, 2006

(65) Prior Publication Data

US 2007/0103503 A1 May 10, 2007

(30) Foreign Application Priority Data

Nov. 9, 2005 (JP) ..... 2005-324728

(51) Int. Cl.
*B41J 2/165* (2006.01)

(52) U.S. Cl. ..... 347/29; 347/32

(58) Field of Classification Search ..... 347/29, 347/30, 32, 33

See application file for complete search history.

(56) References Cited

U.S. PATENT DOCUMENTS 6,984,017 B1 * 1/2006 Berry et al. ..... 347/29

FOREIGN PATENT DOCUMENTS

JP 2001-253080 9/2001
JP 2005-053199 3/2005

* cited by examiner

*Primary Examiner*—shih-wen hsieh
(74) *Attorney, Agent, or Firm*—Workman Nydegger

(57) ABSTRACT

A capping sheet that seals a nozzle surface of a liquid jet head having a liquid jet nozzle that ejects liquid onto a target, the capping sheet includes: a sheet body including an opposite surface facing the nozzle surface of the liquid jet head, the sheet body being provided separately from a capping-sheet carrying mechanism that carries the sheet body from a non-capping position where the opposite surface does not face the nozzle surface to a capping position where the opposite surface faces the nozzle surface; and on the opposite surface, a sealing part that seals the nozzle surface with a sealed space therebetween if the capping sheet is carried to the capping position by the capping-sheet carrying mechanism and relatively moved in a way that the opposite surface comes close to the nozzle surface at the capping position.

8 Claims, 7 Drawing Sheets

CAPPING SHEET AND LIQUID JET APPARATUS

BACKGROUND

1. Technical Field

The present invention relates to a capping sheet and liquid jet apparatus.

2. Related Art

Inkjet printers (hereinafter simply referred to as the "printer(s)") have been widely known as liquid jet apparatus for ejecting liquid from their liquid jet heads onto a target. This type of printers has a problem in that evaporation of ink solvents through the nozzles of their liquid-jet recording head increases ink viscosity and solidifies the ink, and also in that dust cling to the nozzles and bubbles get trapped in the ink. All of these cause nozzle clogging, resulting in print defects.

To address this problem, typical printers have a boxy capping material to seal their recording head in a resting state to prevent ink in the nozzles from drying. The capping material is typically placed in a non-printing area and provides a capping operation by horizontally moving the recording head from a printing position to an area where the capping material is placed. While the capping material seals the head, the space defined by the capping material and head (nozzle surface) is kept wet to prevent ink in the nozzles from drying.

In recent years, printers including a full-line head have been developed for high-speed printing. The head is a large recording head with nozzles arrayed, to the full width of a printing area, in a direction perpendicular to another direction in which a recording medium is fed. With this type of printers, however, it is troublesome to move the heavy recording head to the area where the cap material is placed (non-printing area) to provide the capping operation.

A printer that can solve this problem has been developed. JP-A-2005-53119 is an example of related art. In this type of printer, a capping material forms a unit with a capping-material carrying belt arranged along the circumference of a paper-carrying belt. The capping material is usually placed under the paper-carrying belt. To provide the capping operation, the paper-carrying belt is lowered, and thereafter the capping material is moved by the capping-material carrying belt to a position facing the nozzle surface of the recording head.

The paper-carrying belt is then lifted to press the capping-material carrying belt onto the recording head side, whereby the capping material on the capping-material carrying belt is pressed onto the nozzle surface of the head. This structure therefore provides the capping operation without moving the head from the printing area.

The related-art printer, however, involves the following problems. Since the capping material forms a unit with the capping-material carrying belt, it is troublesome to clean or replace an ink-contaminated capping material. In addition, the mechanism to lift and lower the paper-carrying belt makes the whole structure complicated. Furthermore, the mechanism to lift the paper carrying belt to press the capping-material carrying belt and the capping material thereon onto the nozzle surface of the head would cause undesirable flexure of the paper carrying belt. If the paper-carrying belt has a tendency of such flexure, accuracy in carrying paper (e.g., the distance between the paper and head) can lower.

SUMMARY

An advantage of the present invention is to provide a capping sheet that is efficiently replaceable when contaminated by liquid and to provide liquid jet apparatus including the capping sheet.

A capping sheet according to one aspect of the invention is used to seal a nozzle surface of a liquid jet head having a liquid jet nozzle that ejects liquid onto a target. The capping sheet includes a sheet body having an opposite surface facing the nozzle surface of the liquid jet head. The sheet body is provided separately from a capping-sheet carrying mechanism that carries the sheet body from a non-capping position where the opposite surface does not face the nozzle surface to a capping position where the opposite surface faces the nozzle surface. The capping seat also includes, on the opposite surface, a sealing part that seals the nozzle surface with a sealed space therebetween if the capping sheet is carried to the capping position by the capping-sheet carrying mechanism and relatively moved in a way that the opposite surface comes close to the nozzle surface at the capping position.

This feature enables easy replacement of the capping sheet when contaminated by liquid in the capping operation, since the capping sheet including the sealing part that seals the nozzle surface of the liquid jet head is provided separately from the capping-sheet carrying mechanism.

The sealing part included in the above-described capping sheet may include a plurality of sealing parts provided on the opposite surface.

This feature enables, if one of the sealing parts is contaminated by liquid, other sealing parts to seal the nozzle surface without replacing the capping sheet by adjusting the count of capping sheets carried by the capping-sheet carrying mechanism. In other words, one capping sheet can be used repeatedly with enhanced durability.

The sealing part included in the above-described capping sheet may be a frame-like bank provided on the opposite surface.

For example, it is possible to form a recess on the opposite surface and make a part of the vicinity of the recess on the opposite surface in contact with the nozzle surface to provide the sealing part. In this case, however, the sheet body needs to be thick enough to have the recess. With the above-described feature including the sealing part that is a frame-like bank on the opposite surface of the sheet body, the seat body can be thin enough to facilitate the carriage of the capping sheet.

The above-described capping sheet may also include a carriage bank protruding in a direction in which the sealing part protrudes and provided on an outer side than a position having the sealing part on the sheet body. The carriage bank has a larger protrusion height from the opposite surface than the sealing part has.

When a roller mechanism is used to nip and carry the capping sheet with this feature, for example, not the sealing part but the carriage bank with a larger protrusion height abuts the roller while the sheet is carried. This feature ensures that the nozzle surface of the liquid jet head is sealed, as the sealing part is free from deformation because of being pressed by the roller while the sheet is carried.

The carriage bank included in the above-described capping sheet may be provided like a frame along an outer rim of the sheet body.

Since the carriage bank is provided like a frame along the outer rim of the sheet body, the capping sheet can be carried more surely with the bank abutting the roller, and the rigidity of the sheet body can be reflected on the bank more effectively compared with a case where a discontinuous bank is provided.

A liquid jet apparatus according to another aspect of the invention includes a liquid jet head having a liquid jet nozzle that ejects liquid onto a target, a sheet container that contains the above-described capping sheet in a non-capping position where the capping sheet does not face the nozzle surface of the liquid jet head, and a capping-sheet carrying mechanism that carries the capping sheet from the sheet container to a capping position where the capping sheet faces the nozzle surface.

With this feature, the capping sheet is provided separately from the capping-sheet carrying mechanism and is carried to the capping position by the mechanism for the capping operation. Accordingly, the capping sheet is easily replaceable when contaminated by liquid in the capping operation to provide an efficient liquid jet apparatus.

The above-described liquid jet apparatus may also includes a liquid-jet-head carrying mechanism that moves the liquid jet head toward the capping sheet if the capping-sheet carrying mechanism carries the capping sheet to the capping position.

With this feature, since the liquid-jet-head carrying mechanism carries the liquid jet head toward the capping sheet in order to provide the capping operation, the apparatus structure can be more simple and compact than a case where the capping-sheet carrying mechanism is moved toward the nozzle surface so that the capping sheet comes close to the nozzle surface of the head, for example.

The capping-sheet carrying mechanism included in the above-described liquid jet apparatus may include a plurality of carriage rollers, and a fixed supporting member having a flat supporting surface provided at a position facing the nozzle surface between the rollers. The capping sheet is supported on the supporting surface of the supporting member if the capping sheet is carried to the capping position.

With this feature, the capping sheet is supported on the flat supporting surface of the supporting member to provide the capping operation (e.g., the liquid-jet-head carrying mechanism moves the liquid jet head toward the capping sheet). Accordingly, the capping operation can be provided stably as the capping sheet supported on the supporting member does not tilt. Furthermore, a problem that may arise when the capping sheet is supported on a flexible material like a carrying belt in that the belt sags during the capping operation can be prevented with the structure supporting the capping sheet on the flat supporting surface of the fixed supporting member.

In the liquid jet apparatus, the liquid jet nozzle of the liquid jet head may be arrayed, to the full width of a liquid jet area of the target, in a direction perpendicular to another direction in which the target is carried.

A printer having a full-line liquid jet head is typically large, making it troublesome to move the head in order to provide the capping operation. With the above-described liquid jet apparatus, the capping operation can be easily provided as the capping-sheet carrying mechanism carries the capping sheet.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A first embodiment of the invention will now be described with reference to FIGS. 1 through 6.

Figure 1:
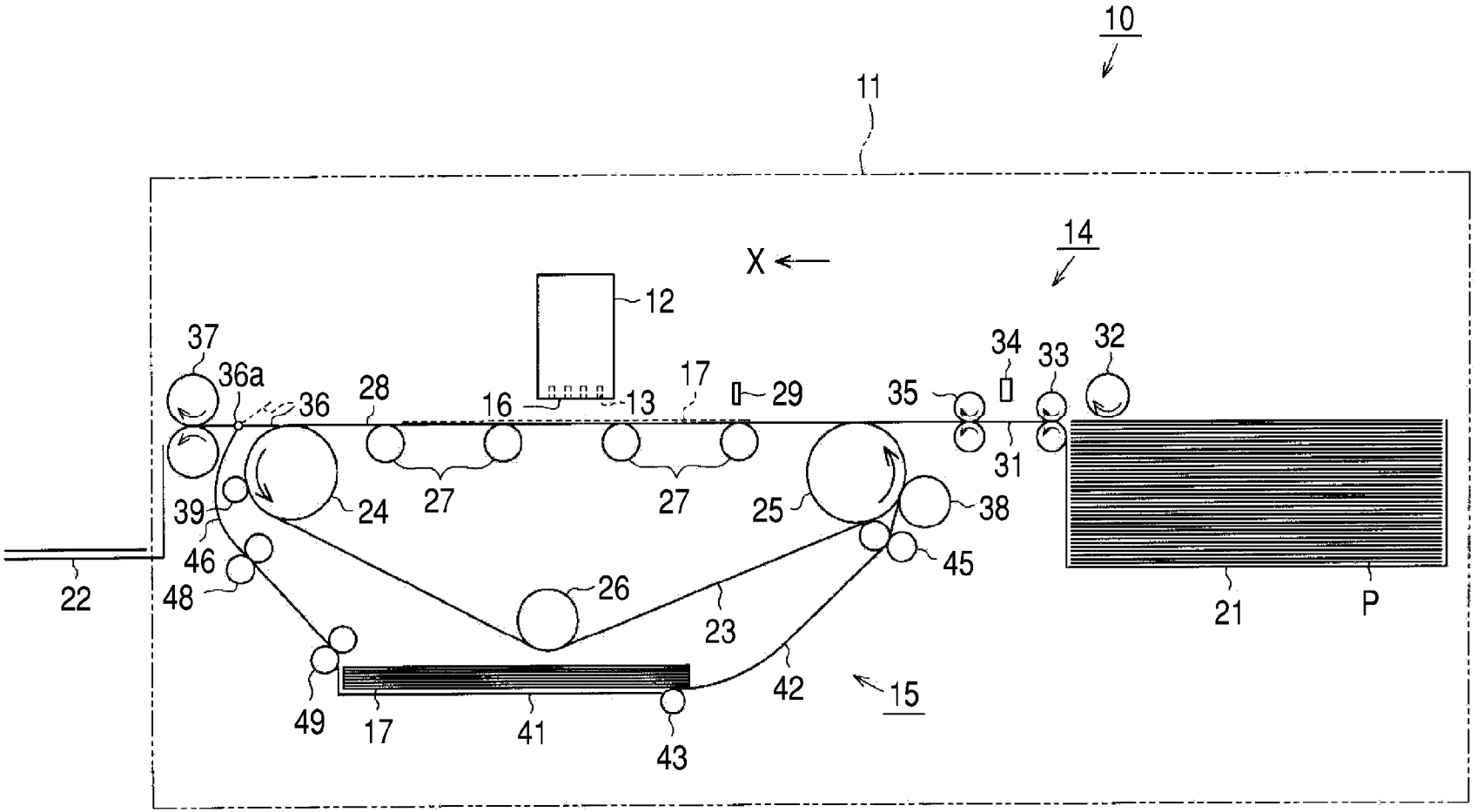
FIG. 1 is a schematic overall view of an inkjet printer according to a first embodiment of the invention.

Referring to FIG. 1, an inkjet printer (hereinafter referred to as the "printer") 10 as liquid jet apparatus according to the first embodiment includes a box-like body case 11 and a recording head 12 (liquid jet head) provided approximately at the center in the body case 11 to eject ink (liquid) onto paper sheets as a target.

The recording head 12 makes no reciprocating motion in a direction perpendicular to another direction X shown by the arrow in FIG. 1 in which a paper sheet P is fed for printing. A plurality of nozzles 13 are provided to the lower face of the head 12 to the full width of the printing area of the paper sheet P in the direction perpendicular to the direction X. The printer 10 of the first embodiment thus has a full-line head, which can provide higher speed printing compared with a printer provided with a head below a carriage reciprocating in the direction perpendicular to the direction X.

The recording head 12 is coupled with a plurality of ink cartridges (not shown) each of which contains ink of different colors. The ink contained in the cartridges is supplied to the head 12 for printing with a predetermined adjusted pressure. By driving a recording-head carrying mechanism 12*a* (i.e., a paper gap adjustment mechanism), the head 12 is movable upward and downward, specifically, forward and backward relative to a main carrying path 28 facing a nozzle surface 16 of the head 12 with a predetermined gap therebetween. The recording-head carrying mechanism 12*a* includes, for example, two guide rods to support the head 12 in the body case 11, eccentric pins provided to the guide rods with their axes tilted in the same direction as the axes of the corresponding rods to affix the rods to the body case 11 in a manner that allows rotation, and a gear mechanism to couple the pins. By rotating the guide rods with one of the pins serving as a rotating center, the other pin is made rotate in the same direction by means of the gear mechanism. The head 12 is thus moved upward and downward by the guide rods.

Provided below the recording head 12 within the body case 11 are a paper carrying mechanism 14 to carry each paper sheet P and a capping-sheet carrying mechanism 15 to carry each capping sheet 17. Made of an elastic material, the capping sheet 17 seals the nozzle surface 16 of the head 12 while the printer 10 is in a resting state to prevent ink in the nozzles 13 from drying.

Figure 6:
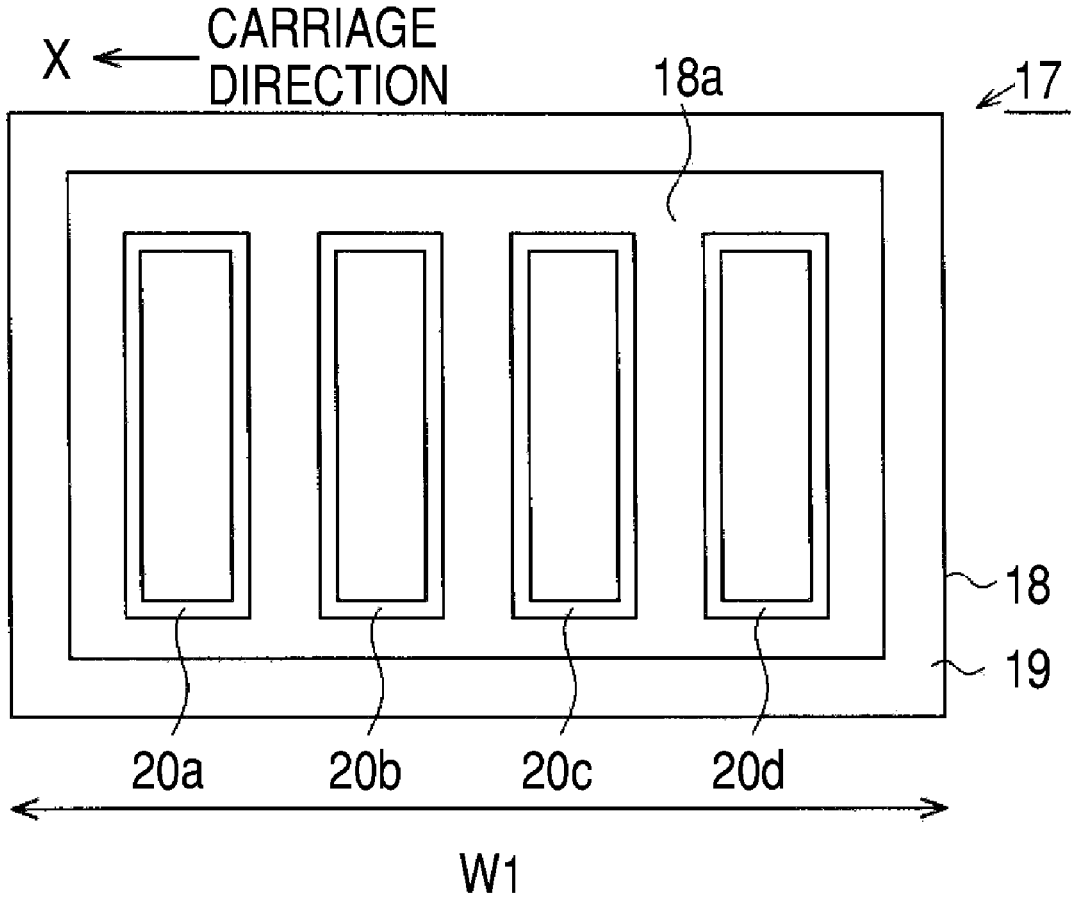
FIG. 6 is a plane view of a capping sheet.

As illustrated in FIG. 6, the capping sheet 17 is a rectangular sheet material on a plane surface. The capping sheet 17 includes a sheet body 18 having an opposite surface 18*a* facing the nozzle surface 16 of the recording head 12. To the outer rim of the sheet body 18, a square frame-like carriage bank 19 is provided in a protruding manner. Inside the carriage bank 19, a plurality of (four in this embodiment) square frame-like banks 20*a*, 20*b*, 20*c*, 20*d* that are seals on a plane surface are provided in a protruding manner.

The frame-like banks 20*a* to 20*d* are approximately as large as the nozzle surface 16 of the recording head 12. For the capping operation, one of the frame-like banks 20*a* to 20*d* is tightly attached to the nozzle surface 16 of the head 12 to seal the nozzle surface 16 with a sealed space therebetween. The carriage bank 19 has a larger protrusion height from the opposite surface 18*a* than the frame-like banks 20*a* to 20*d* have.

The paper carrying mechanism 14 includes a paper feeder tray 21 to accommodate a stack of a plurality of paper sheets P, a paper ejection tray 22 to accommodate printed paper sheets P, and a carrying belt 23 to carry the paper sheets P that have been fed via a position directly under the nozzle surface 16 of the head 12 (position facing the nozzle surface). The carrying belt 23 is stretched with a tension applied by a driving roller 24 (carrying roller) driven after printing starts, a driven roller 25 (carrying roller) rotated in line with the driving roller 24 at the same height as the driving roller 24, and a tension roller 26 placed below the intermediate position from the driving and driven rollers 24 and 25. The driving roller 24, driven roller 25, and tension roller 26 are placed such that the carrying belt 23 is stretched thereon in a triangular shape.

Provided between the driving and driven rollers 24 and 25 are a plurality of (four in this embodiment) auxiliary carrying rollers 27. An upper part of the carrying belt 23 supported horizontally from below by the auxiliary carrying rollers 27 between the driving and driven rollers 24 and 25 serves as the main carrying path 28. Provided above the path 28 on the paper feeder tray 21 side from the head 12 is a print-start sensor 29. This sensor 29 is used to obtain a start point for counting the number of paper sheets P (or the capping sheets 17) that have been carried from the position of the sensor 29 to the printing position (or capping position) directly below the nozzle surface 16 of the head 12.

Provided between the paper feeder tray 21 and carrying belt 23 is a first guide plate 31 to guide the paper sheet P from the tray 21 to the first end of the main carrying path 28 (on the driven roller 25 side on the right in FIG. 1). Upon the tray 21, a pickup roller 32 is provided to pick up the uppermost paper sheet P accommodated in the tray 21. In addition, a pair of separation rollers 33 is provided to a coupling part of the tray 21 and first guide plate 31 to ensure that only one paper sheet P is fed at once out of clinging paper sheets due to friction.

Provided above the first guide plate 31 is a paper-end sensor 34 to sense the paper sheet P that has passed through the pair of separation rollers 33. Furthermore, a pair of paper gate rollers 35 driven when the paper sheet P is carried from the first guide plate 31 onto the main carrying path 38. As the pickup roller 32, pair of separation rollers 33, and pair of paper gate rollers 35 rotate in the direction to feed the paper sheet P toward the main carrying path 28 (the direction shown by the arrow in FIG. 1), the paper sheet P accommodated in the tray 21 is supplied onto the path 28.

Provided between the carrying belt 23 and paper ejection tray 22 is a selector 36 to guide the paper sheet P from a second end of the main carrying path 28 (on the driving roller 24 side on the left in FIG. 1) to the tray 22 and also to send the capping sheet 17 toward a capping-sheet tray 41 serving as a sheet container. The selector 36 is supported in a manner that allows rotation, with a base 36*a* on the downstream of paper feeding (on the left in FIG. 1) as a supporting point. In a horizontal (closed) state as shown by the solid line in FIG. 1, the selector 36 couples the main carrying path 28 with the paper ejection tray 22. When the selector 36 is tilted upward (open state) as shown by the broken line in FIG. 1, the coupling between the main carrying path 28 and paper ejection tray 22 is cut off, and the selector 36 couples the path 28 with a carrying path (third guide plate 46) toward the capping-sheet tray 41.

Provided between the base 36*a* of the selector 36 and the paper ejection tray 22 are a pair of paper ejection rollers 37 to eject the printed paper sheet P to the tray 22. When the selector 36 is in the horizontal (closed) state, the carrying belt 23 and pair of paper ejection rollers 37 rotate, thereby ejecting the printed paper sheet P to the tray 22 from the main carrying path 28.

Furthermore, a charging roller 38 is provided corresponding to the driven roller 25 such that the two rollers rotate while nipping the carrying belt 23. Also, a neutralization roller 39 is provided corresponding to the driving roller 24 such that the two rollers rotate while nipping the carrying belt 23. Since the charging roller 38 makes the whole surface of the carrying belt 23 supporting the paper sheet P (and capping sheet 17) have negative charges, the paper sheet P and capping sheet 17 are tightly held on the main carrying path 28 of the belt 23.

The capping-sheet carrying mechanism 15 includes the capping-sheet tray 41 to accommodate a stack of a plurality of (e.g. five to ten) capping sheets 17, and the carrying belt 23 to carry each capping sheet 17 from the tray 41 via the position directly under the nozzle surface 16 of the recording head 12 (position facing the nozzle surface 16) back to the tray 41. Here, the carrying belt 23 included in the above-described paper carrying mechanism 14 serves as the carrying belt 23 of the capping-sheet carrying mechanism 15.

The capping-sheet tray 41 is located below the carrying belt 23. Provided on the first end (on the right in FIG. 1) of the tray 41 is a second guide plate 42 that is gradually curved to guide the capping sheet 17 from the tray 41 to the first end of the main carrying path 28 (on the driven roller 25 side on the right in FIG. 1). The second guide plate 42 is made of a pair of belt-like plates placed in a direction intersecting another direction in which the capping sheet 17 is guided. The plates are provided in parallel with each other with a slightly smaller gap therebetween than the width of the capping sheet 17. Provided to the lower first end (on the lower right corner in FIG. 1) of the tray 41 is a capping-sheet sending roller 43 to send the lowermost capping sheet 17 accommodated in the tray 41 toward the second guide plate 42.

Provided to the end of the second guide plate 42 (specifically, the pair of belt-like plates) in the carriage direction are a pair of capping-sheet gate rollers 45 driven when the capping sheet 17 is sent from the second guide plate 42 onto the main carrying path 28. As the capping-sheet sending roller 43 and pair of capping-sheet gate rollers 45 rotate in the direction to send the capping sheet 17 toward the path 28 (the direction shown by the arrow in FIG. 1), the capping sheet 17 accommodated in the capping-sheet tray 41 is supplied onto the path 28.

Provided on the second end (on the left in FIG. 1) of the capping-sheet tray 41 is the third guide plate 46 part of which is gradually curved to guide the capping sheet 17 from the second end of the main carrying path 28 (on the driving roller 24 side on the left in FIG. 1) to the second end of the tray 41 (on the left in FIG. 1). The third guide plate 46 is made of a pair of belt-like plates placed in a direction intersecting another direction in which the capping sheet 17 is guided. The plates are provided in parallel with each other with a slightly smaller gap therebetween than the width of the capping sheet 17. When tilted upward (open state) as shown by the broken line in FIG. 1, the selector 36 couples the path 28 with the third guide plate 46 as mentioned above.

Provided on the carrying path of the capping sheet 17 on the third guide plate 46 is a pair of capping-sheet carrying rollers 48 to carry the capping sheet 17 toward the capping-sheet tray 41.

Provided to one end of the third guide plate 46 adjacent to the capping-sheet tray 41 are a pair of capping-sheet ejection rollers 49 to carry the capping sheet 17 back to the tray 41 after printing starts. Consequently, when the selector 36 is tilted upward (open state), the carrying belt 23, pair of capping-sheet carrying rollers 48, and capping-sheet ejection rollers 49 rotate, thereby carrying the capping sheet 17 toward the tray 41. It is understood that, according to the first embodiment, a position where the capping sheet 17 is accommodated in the tray 41 corresponds to the non-capping position, whereas the position facing the nozzle surface 16 of the recording head 12 on the main carrying path 28 of the belt 23 corresponds to the capping position.

Figure 2:
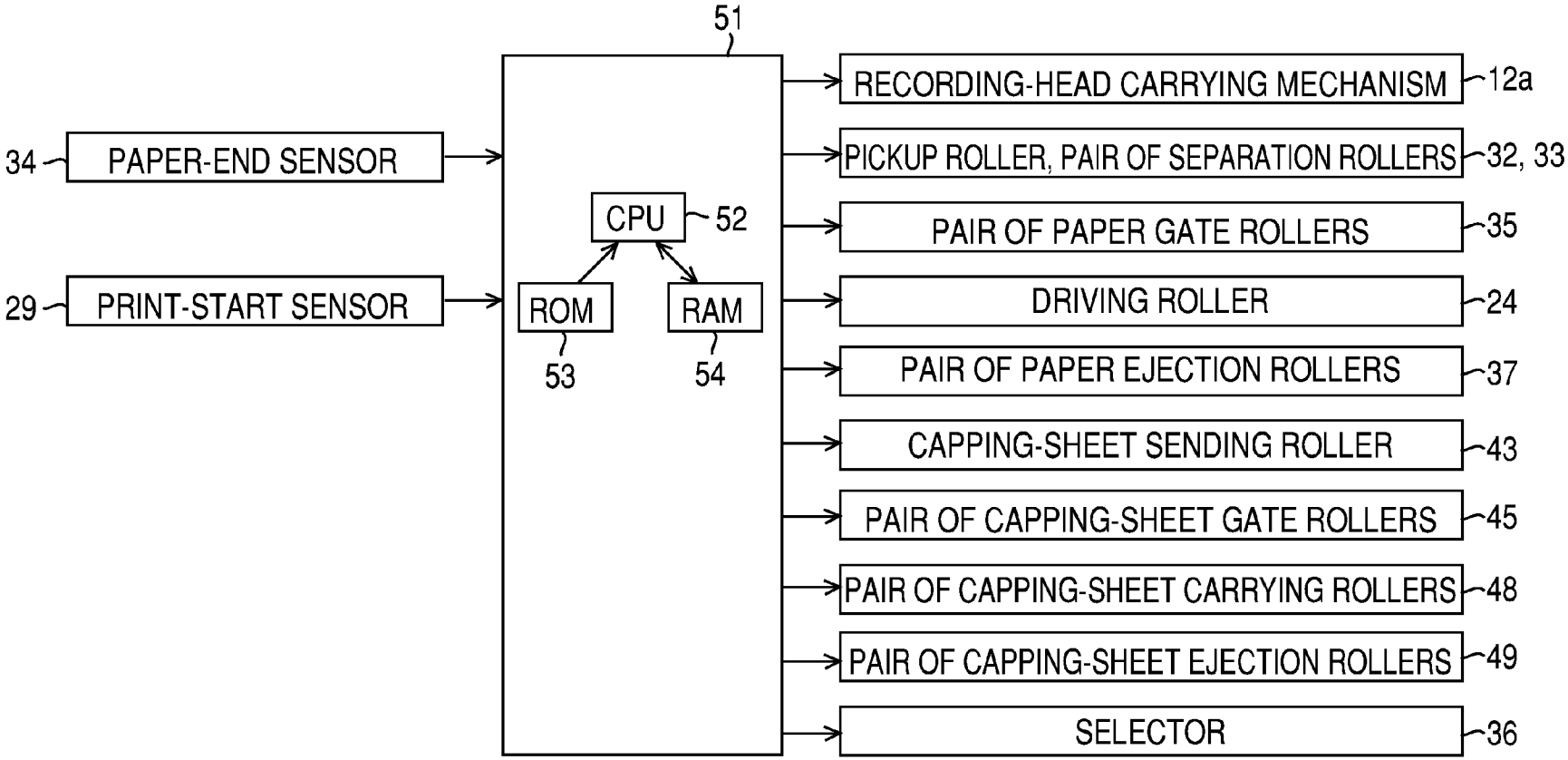
FIG. 2 is a block diagram showing the electric structure of the printer.

Referring now to FIG. 2, the electric structure of the printer 10 will be described.

As illustrated in FIG. 2, the printer 10 is provided with a controller 51 (not shown in FIG. 1 for simplification). The controller 51 includes a central processing unit (CPU) 52 that is coupled to a read-only memory (ROM) 53 and a random access memory (RAM) 54. The ROM 53 stores a control program, for example, for controlling the recording head 12 when ejecting ink on the paper sheet P. The RAM 54 stores and manages various types of information (e.g. signals sensed by each sensor) updated as required during the operation of the printer 10.

The controller 51 is electrically coupled at its input side with the paper-end sensor 34 and print-start sensor 29. The controller 51 is also electrically coupled at its output side with the recording-head carrying mechanism 12*a*, pickup roller 32, pair of separation rollers 33, pair of paper gate rollers 35, driving roller 24, pair of paper ejection rollers 37, capping-sheet sending roller 43, pair of capping-sheet gate rollers 45, pair of capping-sheet carrying rollers 48, pair of capping-sheet ejection rollers 49, and selector 36. The CPU 52 controls the driving of each unit (e.g. the driving roller 24) coupled to the output side based on signals sensed by the sensors 34 and 29 on the input side.

In the printer 10, the paper-carrying path coupling the paper feeder tray 21 and the paper ejection tray 22 via the first guide plate 31 and main carrying path 28 is provided for printing by the switching of the selector 36. To carry the capping sheet 17, the capping-sheet carrying path coupling the first end to the second end of the capping-sheet tray 41 via the second guide plate 42, main carrying path 28, and third guide plate 46 is provided.

Consequently, when the selector 36 is in the horizontal (closed) state as shown by the solid line in FIG. 1, a paper sheet fed out from the paper feeder tray 21 is carried onto the main carrying path 28 via the first guide plate 31. Since the carrying belt 23 is charged, the paper sheet P is tightly held on the belt 23. At the point when the paper sheet P reaches the position facing the nozzle surface 16 of the recording head 12, ink is ejected for printing. The printed paper sheet P is carried onto the main carrying path 28 and ejected to the paper ejection tray 22 via the selector 36.

The capping sheet 17 from the capping-sheet tray 41 is carried onto the main carrying path 28 via the second guide plate 42. In the same manner as mentioned above, since the carrying belt 23 is charged, the capping sheet 17 is tightly held on the belt 23. The capping operation is provided at the point when the capping sheet 17 reaches the position facing the nozzle surface 16 of the recording head 12 as shown by the broken line in FIG. 1. To restart printing, when the selector 36 is tilted (open state) as shown by the broken line in FIG. 1, the capping sheet 17 is carried on the path 28 to the third guide plate 46 via the selector 36. The capping sheet is accommodated in the tray 41 again via the pair of capping-sheet carrying rollers 48 and pair of capping-sheet ejection rollers 49.

Referring now to the flowcharts of FIGS. 3 through 5, the detailed printing process including the capping operation is described below.

Figure 3:
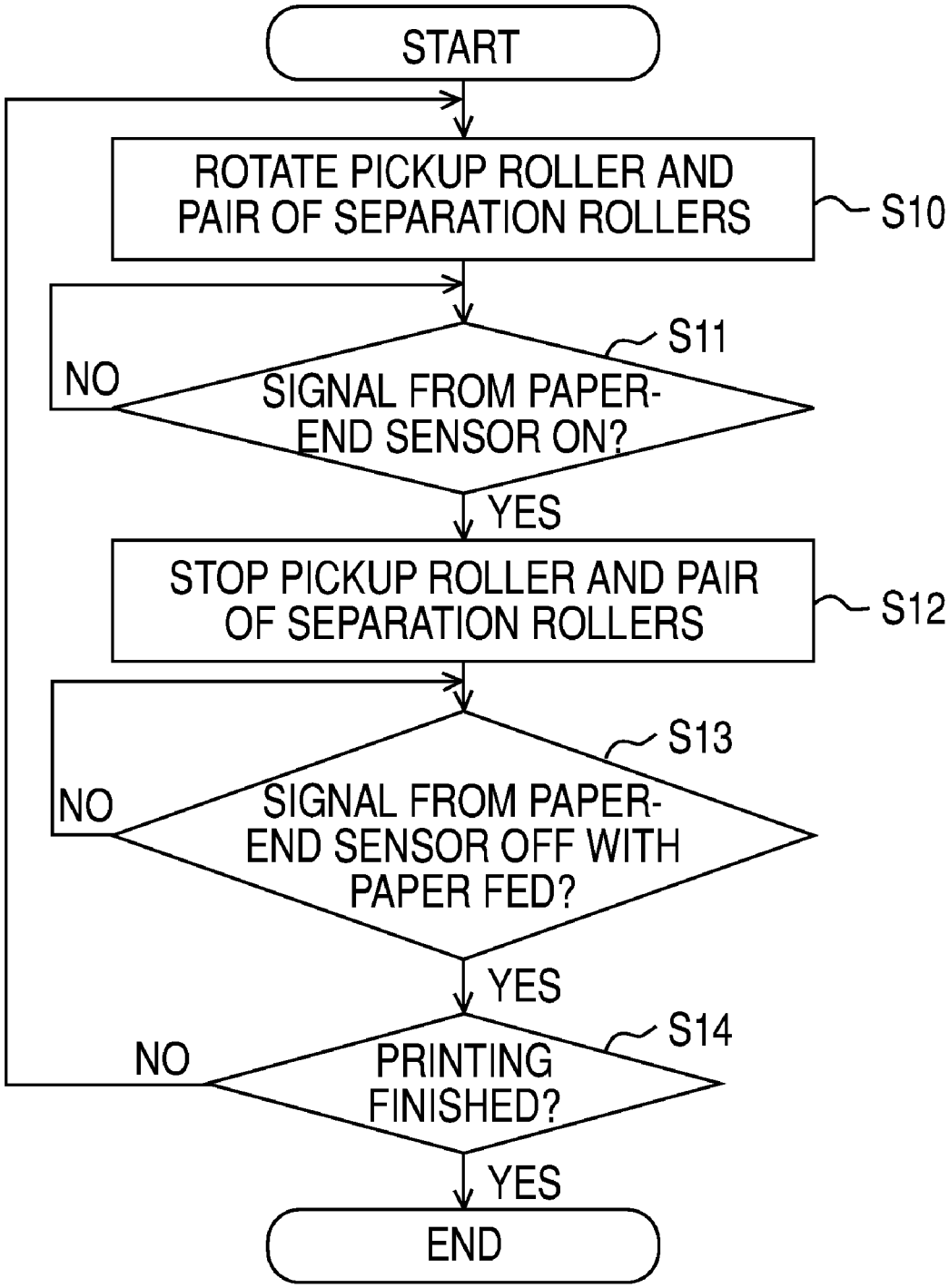
FIG. 3 is a flowchart showing a feeding-waiting process.

FIG. 3 is a flowchart showing a feeding-waiting process. This process ensures that, every time one paper sheet P is fed to the main carrying path 28 for printing, the next paper P waits at the position of the pair of paper gate rollers 35.

As shown in FIG. 3, as printing starts, the CPU 52 makes the pickup roller 32 and pair of separation rollers 33 rotate (Step 10 (S10)) to pick up the uppermost paper sheet P accommodated in the paper feeder tray 21 to be carried onto the first guide plate 31. Next, a signal from the paper-end sensor 34 is judged whether it is ON or not, which means whether the sensor 34 senses a paper sheet P or not (S11). If the signal from the sensor 34 is judged not to be ON (judged to be OFF) (S11: NO), the CPU 52 repeats this judging until an ON signal is sensed. If the signal from the sensor 34 is ON (S11: YES), which means a paper sheet P is carried to the vicinity of the pair of paper gate rollers 35, the pickup roller 32 and pair of separation rollers 33 are made to stop rotating (S12).

Subsequently, a signal from the paper-end sensor 34 is judged whether it is OFF or not, which means whether the paper sheet P is carried toward the main carrying path 28 (S13). If the signal from the sensor 34 is judged not to be OFF (judged to be ON) (S13: NO), the CPU 52 repeats this judging until an OFF signal is sensed. If the signal from the sensor 34 is OFF (S13: YES), which means the paper sheet P passes through the pair of paper gate rollers 35 toward the main carrying path 28. Then, whether printing is finished or not is judged (S14). If printing is judged to be finished (S14: YES), the CPU 52 finishes the feeding-waiting process. If printing is judged not to be finished (S14: NO), the CPU 52 makes the pickup roller 32 and pair of separation rollers 33 rotate (S10) again and repeats the above-described steps S10 through S14 until printing is judged to be finished.

Since the feeding-waiting process is performed according to the first embodiment, the process of printing and capping is performed under the premise that the paper sheet P is waiting at the vicinity of the pair of paper gate rollers 35. FIGS. 4 and 5 are flowcharts showing the process of printing and capping. According to the first embodiment, the feeding-waiting process (FIG. 3) and the process of printing and capping (FIGS. 4 and 5) are performed at the same time as the start of printing. It is understood that the printing starts on the premise that the selector 36 is in the horizontal (closed) state as shown by the solid line in FIG. 1 and the paper carrying path coupling the paper feeder tray 21 and paper ejection tray 22 via the main carrying path 28 is provided. In addition, the recording head 12 is lowered and its nozzle surface 16 is sealed by the frame-like banks 20*a* to 20*d* of the capping sheet 17.

Figure 4:
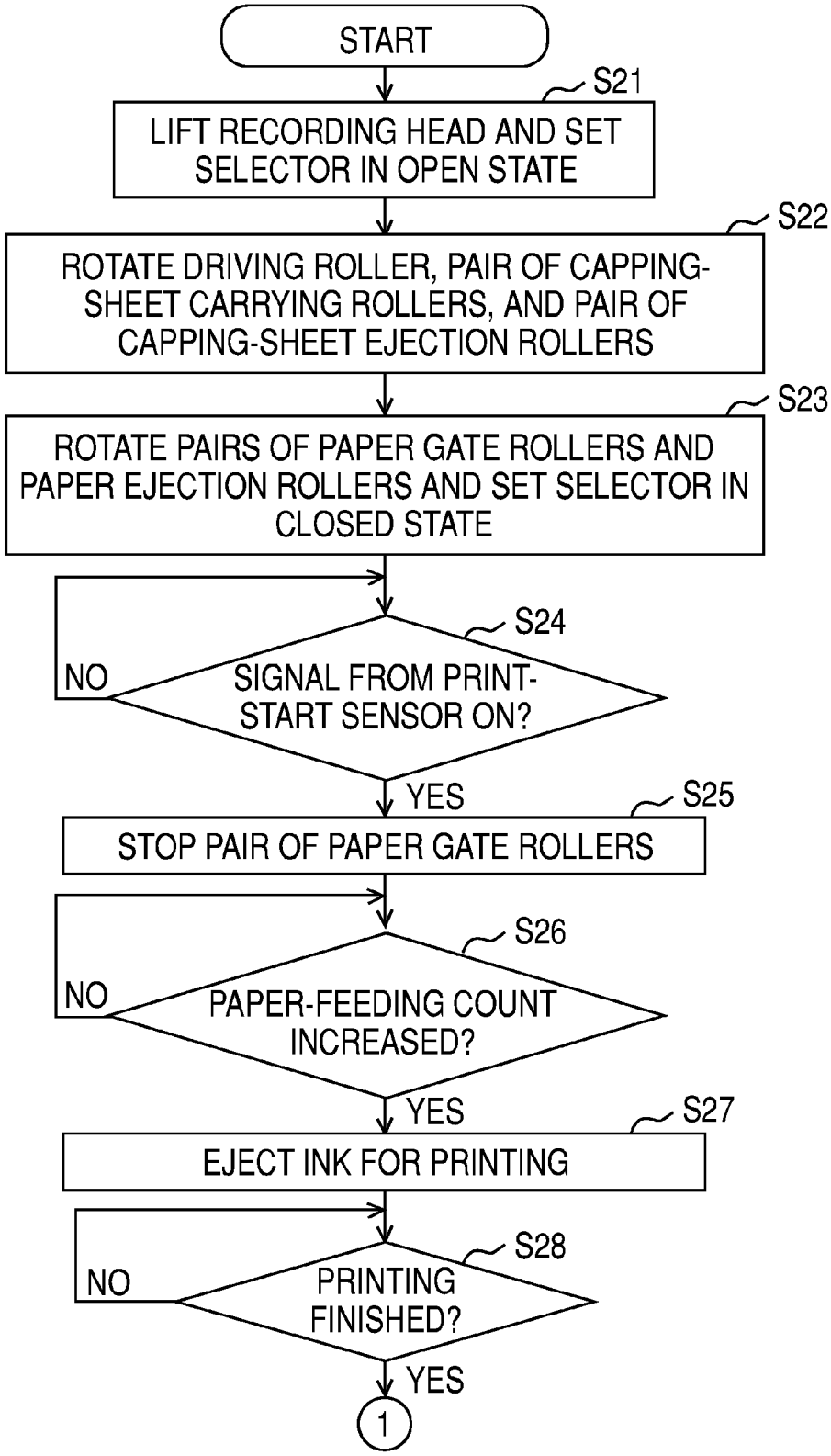
FIG. 4 is a flowchart showing a printing process.
Figure 5:
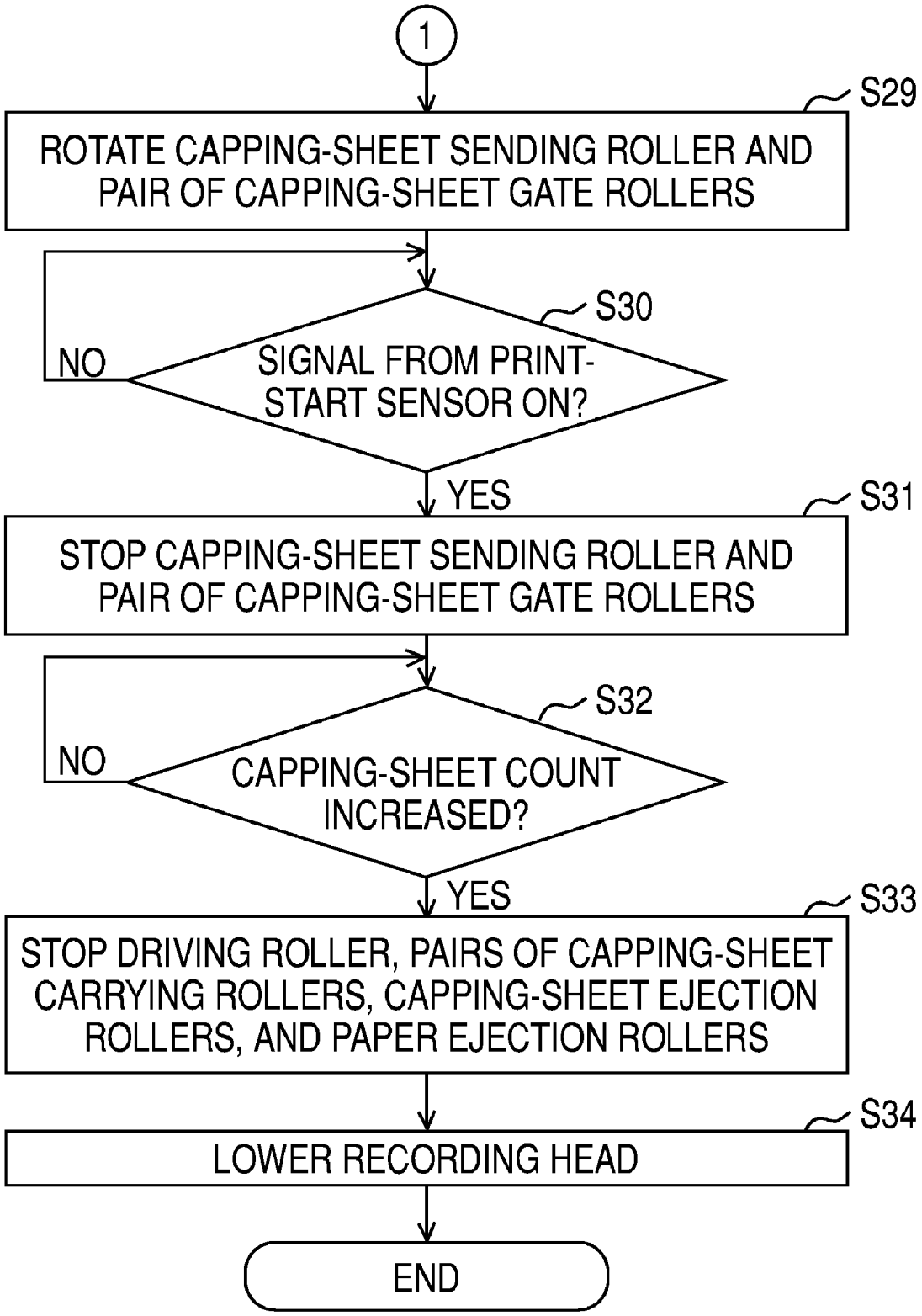
FIG. 5 is a flowchart showing a printing process, especially showing a capping process.

As shown in FIG. 4, when printing starts, the CPU 52 drives the recording-head carrying mechanism 12*a* to lift the recording head 12 and controls the selector 36 to be in an open state (S21). By lifting the head 12, its nozzle surface 16 comes away from the frame-like banks 20*a* to 20*d* of the capping sheet 17. Next, the driving roller 24, pair of capping-sheet carrying rollers 48, and pair of capping-sheet ejection rollers 49 are made to rotate (S22). The capping sheet 17 that has been at the capping position is thus carried from the main carrying path 28 via the selector 36 and third guide plate 46 back to the uppermost position in the capping-sheet tray 41.

The CPU52 then makes the pair of paper gate rollers 35 and pair of paper ejection rollers 37 rotate and controls the selector 36 to be in a closed state (S23). By rotating the pair of paper gate rollers 35, the paper sheet P in a waiting state that has been carried to the rollers 35 is carried onto the main carrying path 28 in the above-described feeding-waiting process. Next, a signal from the print-start sensor 29 on the path 28 is judged whether it is ON or not, which means whether the sensor 29 senses the paper sheet P or not (S24). If the signal from the sensor 29 is not ON (is OFF) (S24: NO), the CPU 52 repeats this judging until an ON signal is sensed. If a signal from the sensor 29 is ON (S24: YES), which means the paper sheet P is carried to a position just ahead of the recording head 12 on the path 28, the pair of paper gate rollers 35 are made to stop rotating (S25).

Subsequently, whether a paper-feeding count increases or not is judged (S26). Here, the count calculated by the CPU 52 increases every time a printing sheet P is fed from the position of the print-start sensor 29 to the printing position. This count is calculated by the CPU based on printing data in advance as printing starts and stored in the RAM. If the count does not increase (S26: NO), the CPU 52 repeats this judging until the count increases. If the count is judged to increase (S26: YES), which means the paper sheet P is carried to the printing position facing the recording head 12, ink is ejected from the nozzles 13 of the head 12 for printing (S27).

Next, whether printing is finished or not is judged (S28). If printing is judged not to be finished (S28: NO), printing is continued until it is judged to be finished. If printing is judged to be finished (S28: YES), the CPU 52 makes the capping-sheet sending roller 43 and pair of capping-sheet gate rollers 45 rotate (S29). Accordingly, the lowermost capping sheet 17 accommodated in the capping-sheet tray 41 is carried onto the main carrying path 28 via the second guide plate 42.

Then, a signal from the print-start sensor 29 on the main carrying path 28 is judged whether it is ON or not, which means whether the sensor 29 senses the capping sheet 17 or not (S30). If the signal from the sensor 29 is not ON (is OFF) (S30: NO), the CPU 52 repeats this judging until an ON signal is sensed. If the signal from the sensor 29 is ON (S30: YES), this means the capping sheet 17 is carried to a position just ahead of the recording head 12 on the path 28.

Consequently, the capping-sheet sending roller 43 and pair of capping-sheet gate rollers 45 are made to stop rotating (S31). Then whether a capping-sheet count increases or not is judged (S32). Here, the capping-sheet count calculated by the CPU 52 increases every time the capping sheet 17 is carried from the position of the print-start sensor 29 to the capping position. Specifically, this count calculated by the CPU 52 increases every time one of the frame-like banks (e.g. the frame-like bank 20*a* throughout the description below) of the capping sheet 17 used for the current capping operation is carried from the position of the sensor 29 to the position facing the nozzle surface 16 of the recording head 12. This count is calculated by the CPU 52 in advance as printing starts and stored in the RAM 54.

If the capping-sheet count does not increase (S32: NO), the CPU 52 repeats this judging until the count increases. If the capping-sheet count is judged to increase (S32: YES), this means the capping sheet 17 (more specifically, the frame-like bank 20*a* used for the current capping operation) reaches the capping position facing the recording head 12.

Consequently, the driving roller 24, pair of capping-sheet carrying rollers 48, pair of capping-sheet ejection rollers 49, and pair of paper ejection rollers 37 are made to stop rotating (S33). The CPU 52 thus drives the recording-head carrying mechanism 12*a* to lower the recording head 12 (S34). Specifically, the head 12 is lowered to come close to the capping sheet 17 facing the nozzle surface 16 of the head 12. Accordingly, the nozzle surface 16 of the head 12 and the frame-like bank 20*a* of the capping sheet 17 used for the current capping operation are in contact with to seal the nozzle surface 16 with a sealed space therebetween.

As mentioned above, the carriage bank 19, provided on the opposite surface 18*a* of the capping sheet 17, has a larger protrusion height from the opposite surface 18*a* than the frame-like banks 20*a* to 20*d* have. Accordingly, not the frame-like banks 20*a* to 20*d* but the carriage bank 19 with a larger protrusion height abuts each pair of rollers (the pairs of capping-sheet gate rollers 45, capping-sheet carrying rollers 48, and capping-sheet ejection rollers 49) while the capping sheet 17 is carried.

According to the first embodiment, the lowermost capping sheet 17 among a plurality of capping sheets 17 accommodated in the capping-sheet tray 41 is first used. Once all of the capping sheets 17 are used, the first capping sheet 17 is used again in a cycle. Here, the usage of the capping sheets 17 is recorded in the RAM 54 to increase the capping-sheet count as they are used, so that the second frame-like bank 20*b* may be used when the capping sheets 17 are used in the second cycle. Here, how many times each of the frame-like banks 20*a* to 20*d* is repeatedly used can be set as required. It is possible to keep using one of the frame-like banks 20*a* to 20*d* for multiple times, for example, using the first frame-like bank 20*a* when one capping sheet is used for the first and second times, and using the second frame-like bank 20*b* when the same capping sheet is used for the third and fourth times.

The first embodiment has the following advantages.

(1) Since the capping sheet 17 is provided separately from the capping-sheet carrying mechanism 15 according to the first embodiment, the capping sheet 17 is easily replaceable when the frame-like banks 20*a* to 20*d* are contaminated by ink during the capping operation or are damaged by aging, for example.

(2) Since the plurality of frame-like banks 20*a* to 20*d* are protruding on the opposite surface 18*a* of the capping sheet 17 according to the first embodiment, each of the banks 20*a* to 20*d* can be used to seal the nozzle surface 16 of the recording head 12 by adjusting the count of capping sheets carried by the capping-sheet carrying mechanism 15. In other words, even if one of the banks 20*a* to 20*d* is contaminated by ink, one capping sheet 17 can be used repeatedly with enhanced durability.

(3) Since the carriage bank 19 has a larger protrusion height from the opposite surface 18*a* than the frame-like banks 20*a* to 20*d* have according to the first embodiment, not the frame-like banks 20*a* to 20*d* but the carriage bank 19 abuts each pair of rollers (the pairs of capping-sheet gate rollers 45, capping-sheet carrying rollers 48, and capping-sheet ejection rollers 49). This feature ensures that the nozzle surface 16 of the recording head 12 is sealed, as the banks 20*a* to 20*d* are free from deformation because of being pressed by each pair of rollers while the sheet is carried. It is also possible to prevent ink adhered to the banks 20*a* to 20*d* attach each pair of rollers, thereby contaminating the paper sheet P.

(4) Since the carriage bank 19 according to the first embodiment is provided along the outer rim of the sheet body 18, the capping sheet 17 can be carried more surely with the bank 19 abutting each pair of rollers compared with a case where a plurality of non-frame-like, discontinuous banks are provided. Moreover, the sheet body 18 with the frame-like carriage bank 19 provided along its outer rim is more rigid than a sheet body with a plurality of discontinuous carriage banks.

(5) The first embodiment provides the capping operation by lowering the recording head 12 so as to come close to the capping sheet 17. Accordingly, the apparatus structure can be more simple and compact than a case where the capping-sheet carrying mechanism 15 is moved toward the nozzle surface 16 so that the capping sheet 17 comes close to the nozzle surface 16 of the head 12, for example.

Second Embodiment

Figure 7:
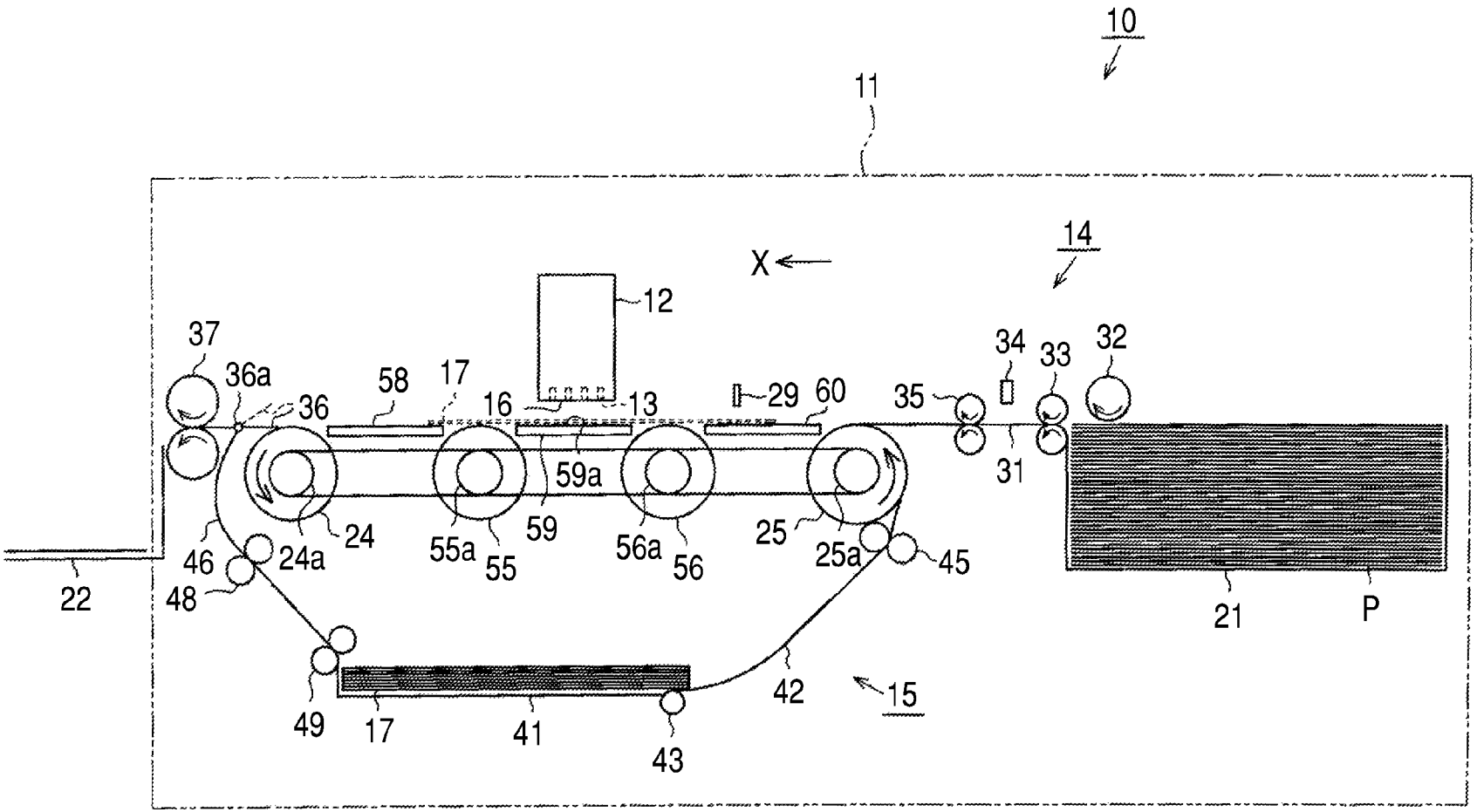
FIG. 7 is a schematic overall view of an inkjet printer according to a second embodiment of the invention.

Referring now to FIG. 7, a second embodiment of the invention will be described. The description of the second embodiment will focus on part of its feature that differs from the first embodiment's feature. Like numerals indicate like elements in the two embodiments and thus repeated description will be omitted.

In the printer 10 of the present embodiment, the carrying belt 23 included in the paper carrying mechanism 14 and capping-sheet carrying mechanism 15, and the charging roller 38 and neutralization roller 39 according to the first embodiment are replaced with two driven rollers 55 and 56 provided between the driving and driven rollers 24 and 25. The driving roller 24 and driven rollers 25, 55, 56 are fitted with pinions 24*a*, 25*a*, 55*a*, 56*a*, respectively, rotating coaxially with the corresponding rollers. On these pinions 24*a*, 25*a*, 55*a*, 56*a*, a seamless connection belt 57 is mounted, whereby the driven rollers 25, 55, 56 rotate in synchronization with the driven rotation of the driving roller 24.

Provided between the driving and driven rollers 24 and 55 above the connection belt 57 is a platen 58 to support the capping sheet 17 (or paper sheet P) while being carried. In a similar manner, a platen 59 as a supporting member is provided between the driven rollers 55 and 56, and a platen 60 between the driven rollers 56 and 25. With the three platens 58, 59, 60 arranged nearly linearly, the flat top surface of each platen serves as a supporting surface to support and carry the capping sheet 17 (or paper sheet P). It is noted that, according to the second embodiment, the width W1 (see FIG. 6) of the capping sheet 17 in the direction in which it is carried is set larger than the gap between the each adjacent two rollers (between the driven rollers 24 and 56, between the driven rollers 56 and 55, and between the driven and driving rollers 55 and 24).

The platen 59 between the driven rollers 55 and 56 is placed such that its upper surface 59*a* faces the nozzle surface 16 of the recording head 12. Accordingly, the head 12 is lowered to seal its nozzle surface 16 during the capping operation with the capping sheet 17 supported on the upper surface 59*a* of the platen 59 as shown by the broken line in FIG. 7.

The second embodiment has the following advantages in addition to the above-described advantages 1 to 5 of the first embodiment.

(6) The second embodiment provides the capping operation with the capping sheet 17 supported on the flat upper surface (supporting surface) 59*a* of the platen (supporting member) 59. Accordingly, the capping operation can be provided stably as the capping sheet 17 supported on the upper surface 59*a* of the platen 59 does not tilt. Furthermore, a problem that may arise when the capping sheet 17 is supported on a flexible material like the carrying belt 23 in that the belt 23 sags during the capping operation, resulting in lowered accuracy in carrying the paper sheet P, can be prevented with the structure supporting the capping sheet on the upper surface 59*a* of the platen 59 that is fixed.

The following modifications can be made to the above-described embodiments.

The features according to the embodiments described above may include a single capping sheet 17 that is used repeatedly instead of the plurality of capping sheets 17.

The features according to the embodiments may include a single frame-like bank instead of the plurality of frame-like banks 20*a* to 20*d*. Also, the number of the banks may be larger than four.

The sealing part (frame-like banks 20*a* to 20*d*) of the capping sheet 17 according to the embodiments may be replaced by a recess provided on the opposite surface 18*a* of the sheet body 18. In this case, part of the outer rim of the recess on the opposite surface 18*a* serves as a sealing part in contact with the nozzle surface 16 to seal the nozzle surface 16 with a sealed space in the recess.

The carriage bank 19 of the capping sheet 17 according to the embodiments may not be formed in a frame-like shape. In addition, the carriage bank may be provided to a place other than the outer rim of the sheet body 18 as long as the carriage bank is on the outer side of the frame-like banks 20*a* to 20*d*. Furthermore, the features may include the banks 20*a* to 20*d* as sealing parts without the carriage bank 19 by arranging each pair of rollers not to abut the banks 20*a* to 20*d*.

According to the embodiments, the invention is also applicable to printers without a full-line head.

While the printer 10 ejecting ink is used as liquid jet apparatus in the embodiments, the invention is also applicable to other types of liquid jet apparatus. For example, the apparatus may be printers including fax machines and copiers; liquid jet apparatus that ejects electrode materials, color materials, and other liquid used to manufacture liquid crystal displays, electroluminescent (EL) displays, and surface-emitting displays; liquid jet apparatus that ejects bioorganics to manufacture biochips; and sample jet apparatus used as a precision pipette. Moreover, the liquid is not limited to ink and other types of liquid can be used as well.

The entire disclosure of Japanese Patent Application No. 2005-324728, field Nov. 09, 2006 is expressly incorporated by reference herein.

What is claimed is:

1. A capping sheet that seals a liquid jet head having liquid jet nozzles that eject liquid onto a target, the capping sheet comprising:

a sheet body including an opposite surface facing a nozzle surface of the liquid jet head, the sheet body being provided separately from a capping-sheet carrying mechanism that carries the sheet body from a non-capping position where the opposite surface does not face the nozzle surface to a capping position where the opposite surface faces the nozzle surface;

on the opposite surface, a sealing part that seals the liquid jet head with a sealed space therebetween if the capping sheet is carried to the capping position by the capping-sheet carrying mechanism and relatively moved in a way that the opposite surface comes close to the nozzle surface at the capping position; and a carriage bank protruding in a direction in which the sealing part protrudes and provided on an outer side than a position having the sealing part on the sheet body, the carriage bank having a larger protrusion height from the opposite surface than the sealing part has.

2. The capping sheet according to claim 1, wherein the sealing part includes a plurality of sealing parts provided on the opposite surface.

3. The capping sheet according to claim 1, wherein the sealing part is a frame-like bank provided on the opposite surface.

4. The capping sheet according to claim 1, wherein the carriage bank is provided like a frame along an outer rim of the sheet body.

5. A liquid jet apparatus comprising:

a liquid jet head having a liquid jet nozzle that ejects liquid onto a target;

a sheet container that contains the capping sheet according to claim 1 in a non-capping position where the capping sheet does not face the nozzle surface of the liquid jet head;

a capping-sheet carrying mechanism that carries the capping sheet from the sheet container to a capping position where the capping sheet faces the nozzle surface; and a carriage bank protruding in a direction in which the sealing part protrudes and provided on an outer side than a position having the sealing part on the sheet body, the carriage bank having a larger protrusion height from the opposite surface than the sealing part has.

6. The liquid jet apparatus according to claim 5, further comprising:

a liquid-jet-head carrying mechanism that moves the liquid jet head toward the capping sheet if the capping-sheet carrying mechanism carries the capping sheet to the capping position.

7. The liquid jet apparatus according to claim 5, wherein the capping-sheet carrying mechanism includes a plurality of carriage rollers, and a fixed supporting member having a flat supporting surface provided at a position facing the nozzle surface between the rollers, and the capping sheet is supported on the supporting surface of the supporting member if the capping sheet is carried to the capping position.

8. The liquid jet apparatus according to claim 5, wherein the liquid jet nozzle of the liquid jet head is arrayed, to a full width of a liquid jet area of the target, in a direction perpendicular to another direction in which the target is carried.

* * * * *